US007538493B2

(12) United States Patent
Kim

(10) Patent No.: US 7,538,493 B2
(45) Date of Patent: May 26, 2009

(54) PLASMA DISPLAY PANEL WITH IMPROVED PROTECTING LAYER

(75) Inventor: Se-Jong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 509 days.

(21) Appl. No.: 11/371,018

(22) Filed: Mar. 9, 2006

(65) Prior Publication Data

US 2006/0214586 A1 Sep. 28, 2006

(30) Foreign Application Priority Data

Mar. 23, 2005 (KR) ..... 10-2005-0024270

(51) Int. Cl.
*H01J 17/49* (2006.01)

(52) U.S. Cl. ..... 313/587; 313/582; 313/585; 313/586

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 7,276,850 | B2 * | 10/2007 | Chung | 313/586 |
| 2001/0006326 | A1 * | 7/2001 | Shirozu | 313/582 |
| 2001/0015623 | A1 * | 8/2001 | Takada et al. | 313/586 |
| 2003/0038599 | A1 * | 2/2003 | Aoki et al. | 313/587 |
| 2003/0151363 | A1 * | 8/2003 | Lee et al. | 313/587 |
| 2004/0075388 | A1 * | 4/2004 | Miyashita et al. | 313/586 |
| 2005/0275350 | A1 * | 12/2005 | Kobayashi | 313/582 |
| 2007/0231996 | A1 * | 10/2007 | Kim et al. | 438/251 |

FOREIGN PATENT DOCUMENTS

| | | |
|---|---|---|
| JP | 05-234519 | 9/1993 |
| JP | 05-283008 | 10/1993 |
| JP | 08-287833 | 11/1996 |
| JP | 11-213869 | 8/1999 |
| JP | 2000-285811 | 10/2000 |
| JP | 2001-118518 | 4/2001 |
| JP | 2002-110050 | 4/2002 |
| JP | 2003-203574 | 7/2003 |
| JP | 2004-055180 | 2/2004 |
| JP | 2004-087166 | 3/2004 |
| JP | 2004-327225 | 11/2004 |
| KR | 2003-0024923 | 3/2003 |

* cited by examiner

*Primary Examiner*—Sikha Roy
*Assistant Examiner*—Jose M Diaz
(74) *Attorney, Agent, or Firm*—H.C. Park & Associates, PLC

(57) ABSTRACT

A plasma display panel including a dielectric layer, which covers X and Y electrodes and has a groove interposed between the X and Y electrode. The growth direction of crystals of a protecting layer disposed on the groove where discharge is focused is optimized to increase the expected life of the plasma display panel and to increase the amount of discharge. The plasma display panel includes a front substrate and a rear substrate facing each other, discharge cells interposed between the front substrate and the rear substrate, X and Y electrodes extending parallel to each other, and a dielectric layer that covers the X and Y electrodes and has a groove with an inclined surface interposed between the electrodes. A (1,1,1) growth direction of the crystals corresponding to the inclined surface of the groove is perpendicular to the inclined surface of the groove.

14 Claims, 5 Drawing Sheets

PLASMA DISPLAY PANEL WITH IMPROVED PROTECTING LAYER

CROSS REFERENCE TO RELATED APPLICATION

This application claims priority to and the benefit of Korean Patent Application No. 10-2005-0024270, filed on Mar. 23, 2005, which is hereby incorporated by reference for all purposes as if fully set forth herein.

BACKGROUND OF THE INVENTION

1. Field of the Invention

The present invention relates to a plasma display panel, and more particularly, to a plasma display panel with a longer expected life and increased discharge by optimizing the growth direction of crystals of a protecting layer.

2. Discussion of the Background

Plasma display panels (PDPs), which display images by gas discharge, can be easily produced and produce high quality display characteristics, including for example display capacity, luminance, contrast, after-image, and viewing angle. In a PDP, a direct current or an alternating current is applied to electrodes to generate a discharge in a discharge cell filled with a discharge gas, thus emitting ultraviolet rays. The emitted ultraviolet rays excite a fluorescent material to emit visible rays, thereby forming an image.

PDPs can be expensive to purchase by a consumer, and must be constantly stabilized for extended use because they are mainly used in home TV receivers or as display devices for industrial use. However, since a PDP forms an image by successive and frequent discharge in the discharge cells of unit pixels, PDP components located in the discharge cells are protected from collision with charged particles accelerated from discharge. Forming a protecting layer inside the discharge cells provides such protection.

However, in time, even the protecting layer can be damaged by repeated collisions with the accelerated charged particles. The degree of damage to the protecting layer determines the expected life of the PDP. Accordingly, to increase the expected life of the PDP, the protecting layer may include a crystal structure with high sputtering resistance. High sputtering resistance indicates that the crystal structure can withstand repeated collisions with accelerated charged particles.

Thus, the protecting layer protects components of a PDP, and also supplements discharge by emitting secondary electrons in response to collision with the accelerated charged particles. Because these functions improve discharge characteristics of a PDP, a protecting layer that can withstand collisions with the charged particles and can emit secondary electrons to supplement discharge would be desired in a PDP.

SUMMARY OF THE INVENTION

This invention provides a plasma display panel (PDP) in which a growth direction of a protecting layer is optimized to improve a sputtering resistance, thus increasing the expected life of the PDP.

Additional features of the invention will be set forth in the description which follows, and in part will be apparent from the description, or may be learned by practice of the invention.

The present invention discloses a plasma display panel including a transparent front substrate and a rear substrate facing each other, partition walls that define discharge cells and which are interposed between the transparent front substrate and the rear substrate, a first electrode and a second electrode interposed between the transparent front substrate and the rear substrate and corresponding to the discharge cells, a dielectric layer covering the first electrode and the second electrode and having a groove with a first inclined surface interposed between a first electrode and a second electrode, a protecting layer covering the dielectric layer, a fluorescent layer disposed in a discharge cell, and a discharge gas disposed in the discharge cell. Further, a (1,1,1) growth direction of crystals of the protecting layer corresponding to the first inclined surface of the groove is substantially perpendicular to the first inclined surface of the groove.

The present invention also discloses a plasma display panel including a transparent front substrate and a rear substrate facing each other, partition walls that define discharge cells and which are interposed between the transparent front substrate and the rear substrate, an X electrode extending in first direction and a Y electrode arranged substantially parallel to the X electrode, the X electrode and the Y electrode fixed to the transparent front substrate, a first dielectric layer covering the X electrode and the Y electrode, and having a groove with a first inclined surface interposed between the X electrode and the Y electrode, a protecting layer covering the first dielectric layer, a fluorescent layer disposed in a discharge cell, and a discharge gas disposed in the discharge cell. Further, a (1,1,1) growth direction of crystals of the protecting layer corresponding to the first inclined surface of the groove is substantially perpendicular to the first inclined surface of the groove.

The present invention also discloses a plasma display panel including a transparent front substrate and a rear substrate facing each other, partition walls that define discharge cells and which are interposed between the transparent front substrate and the rear substrate, an X electrode extending in first direction and a Y electrode arranged substantially parallel to the X electrode, the X electrode and the Y electrode fixed to the rear substrate, a first dielectric layer covering the X electrode and the Y electrode, and having a groove with a first inclined surface interposed between the X electrode and the Y electrode, a protecting layer covering the first dielectric layer, a fluorescent layer disposed in a discharge cell, and a discharge gas disposed in the discharge cell. Further, a (1,1,1) growth direction of crystals of the protecting layer corresponding to the first inclined surface of the groove is substantially perpendicular to the first inclined surface of the groove.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
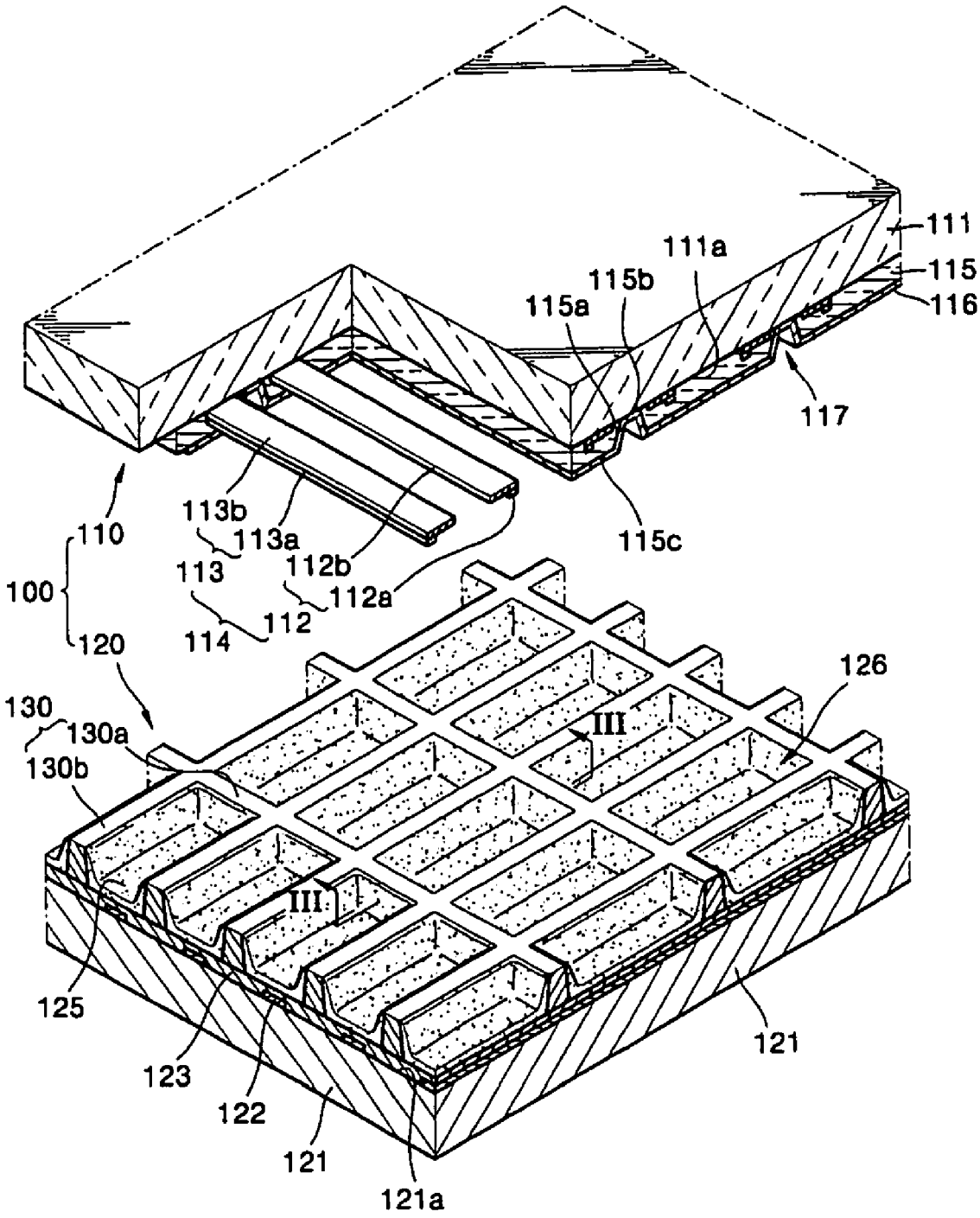
FIG. 1 shows an exploded perspective view of a plasma display panel (PDP) according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

A plasma display panel (PDP) according to an exemplary embodiment of the present invention will now be described in detail with reference to FIG. 1, FIG. 2, and FIG. 3.

Figure 2:
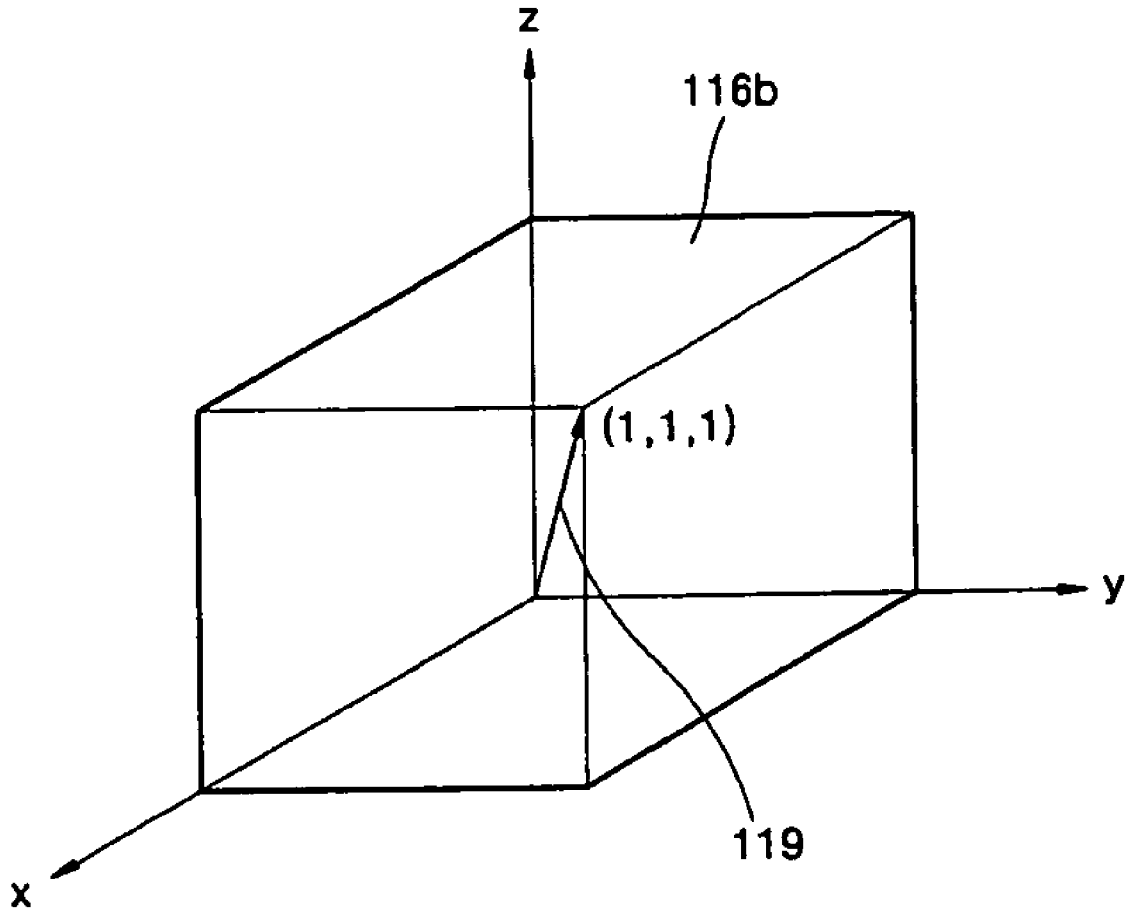
FIG. 2 shows a schematic view illustrating a (1,1,1) growth direction of a crystal of a protecting layer of a PDP according to an exemplary embodiment of the present invention.
Figure 3:
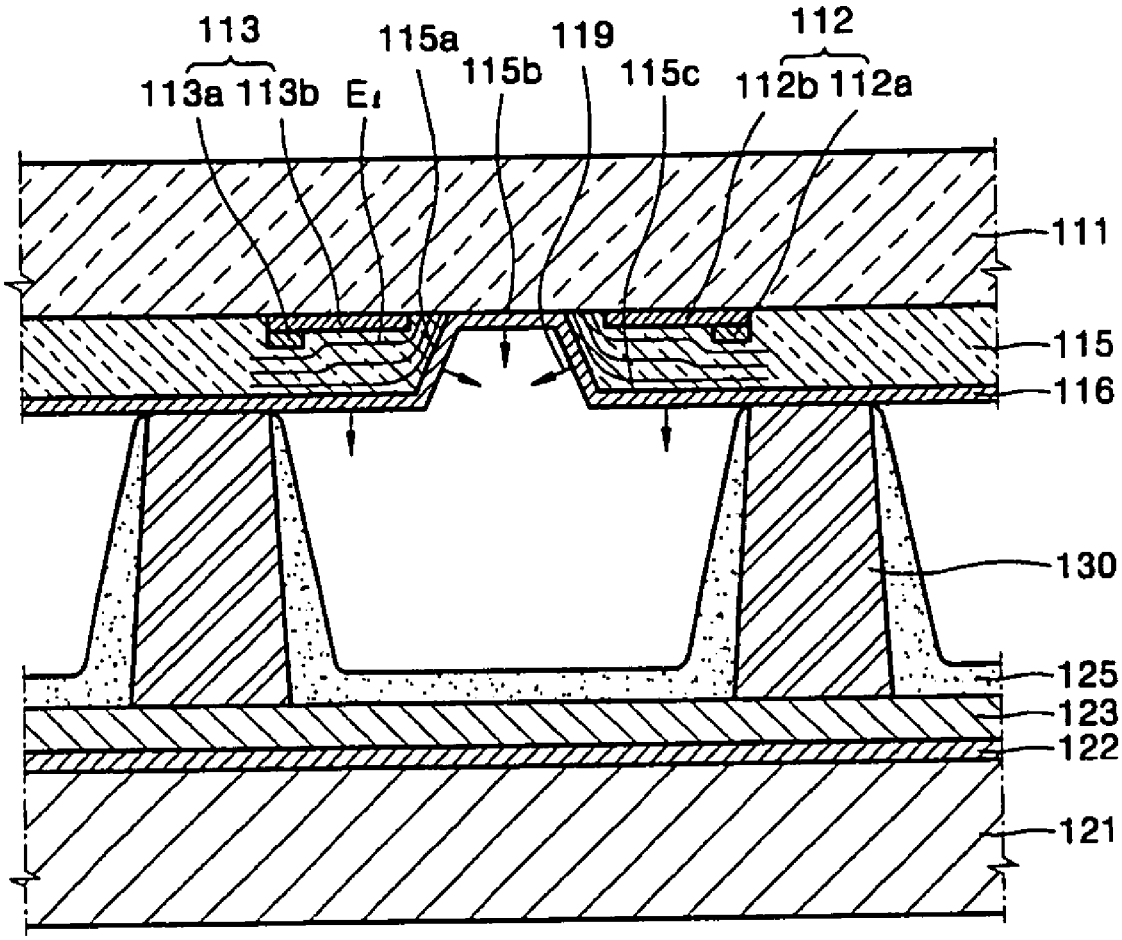
FIG. 3 shows a sectional view taken along line III-III of FIG. 1.

Referring to FIG. 1 and FIG. 2, a PDP 100 includes a front panel 110 and a rear panel 120. The front panel 110 includes a front substrate 111 formed of a transparent soda glass or similar material. The rear panel 120 includes a rear substrate 121 facing the front substrate 111. Similar to the front substrate 111, the rear substrate 121 can be formed of a transparent glass or similar material. However, the rear substrate 121 may also be formed of non-transparent materials, such as metal or plastic since the rear substrate 121 is located outside a light path of visible rays generated in a fluorescent layer 125, which is described below.

The front panel 110 includes a plurality of pairs of electrodes 114, which are fixed to the front substrate 111. Each pair of electrodes 114 includes an X electrode 113 and a Y electrode 112. The electrodes 114 are fixed to a rear surface 111*a* of the front substrate 111. Therefore when a layer having a specific function, such as a near infrared ray-shielding layer or an electromagnetic wave-shielding layer, is also disposed on the rear surface 111*a* of the front substrate 111, the electrodes 114 can be formed on the layer having a specific function so that the electrodes 114 can move concurrently with any physical movement of the front substrate 111.

Although the electrodes 114 of the PDP 100 are fixed to the front substrate 111 in the present exemplary embodiment, they may be positioned elsewhere in the PDP. For example, in some cases, the electrodes 114 can be disposed inside partition walls inside the PDP, or can be fixed to a rear substrate 121 of a PDP 200 according to a second exemplary embodiment of the present invention, which will be described later.

Since the Y electrodes 112 and the X electrodes 113 are respectively fixed to the front substrate 111 in the light path of visible rays generated in a fluorescent layer 125, the Y electrodes 112 may include transparent electrodes 112*b* and the X electrodes 113 may include transparent electrodes 113*b*, where transparent electrodes 112*b* and 113*b* are formed of ITO or similar materials to transmit the visible rays.

In a large PDP, non-uniform discharge may occur because the transparent electrodes 112*b* and 113*b* may have high resistance and excessively impede the flow of current. Accordingly, the X electrodes 113 may have bus electrodes 113*a* and the Y electrodes 112 may have bus electrodes 112*a*, where the bus electrodes 113*a* and 112*a* are formed of highly conductive metals.

The X electrodes 113 and the Y electrodes 112 may extend parallel to each other.

The front panel 110 includes a first dielectric layer 115, which covers the electrodes 114 and includes a plurality of grooves 117 with inclined surfaces 115*a* interposed between an X electrode 113 and a corresponding Y electrode 112. The first dielectric layer 115 also includes a planar surface 115*c*, which may be parallel to the front substrate 111, and is separate from inclined surfaces 115*a* and outside of the grooves 117. The first dielectric layer 115 prevents direct collision between accelerated charged particles and the electrodes 114. In addition, the first dielectric layer 115 accumulates wall charges when charged particles are induced by dielectric polarization, which occurs when an electric potential difference is formed between an X electrode 113 and a Y electrode 112.

Additionally, the grooves 117 facilitate discharge because an electric field formed when an electric potential difference is formed between an X electrode 113 and a Y electrode 12 is focused in the groove 117.

Further, the grooves 117 may expose a portion of the front substrate 111 to the discharge cell 126 by removing an unnecessary portion of the first dielectric layer 115. Generally, as a dielectric layer increases in thickness, the non-effective electric power generated with displacement current increases, thereby increasing power consumption of the PDP.

The grooves 117 may have recessed surfaces 111*b* that are coupled with the inclined surfaces 115*a*. The grooves 117 will be described in further detail below in conjunction with description of PDP 100 operation.

The front panel 110 includes a protecting layer 116 that covers the first dielectric layer 115 to protect the electrodes 114 and the first dielectric layer 115 from accelerated particle collision, particularly accelerated particle collision due to sustain discharge. In addition, the protecting layer 116 can emit secondary electrons to supplement discharge in discharge cells 126.

The protecting layer 116 can be formed of MgO with a thickness of about 0.7 μm using vacuum equipment, such as an e-beam evaporator, a sputtering method, or similar method.

Although the protecting layer 116 covers the first dielectric layer 115, protecting layer 116 properties may vary according to the crystal structure of the protecting layer 116. In particular, a growth direction of crystals of the protecting layer 116 is directly related to the available sputtering resistance and the number of secondary electrons emitted from the protecting layer 116. Therefore, the expected life and discharge characteristics of the PDP are highly dependent on the growth direction of crystals of the protecting layer 116.

In particular, when a crystal 116*b* of the protecting layer 116 is described using a space coordination of x axis, y axis and z axis, the (1,1,1) growth direction 119 of the crystal 116*b* determines the sputtering resistance and number of emitted secondary electrons provided by the protecting layer 116.

The growth direction 119 of the protecting layer 116 of the PDP 100 according to an exemplary embodiment of the present invention will be described in detail later in conjunction with description of PDP 100 operation.

The rear panel 120 includes a plurality of partition walls 130, which may include horizontal partition walls 130*a* extending in a first direction and vertical partition walls 130*b* extending substantially perpendicular to the first direction to define the discharge cells 126 where discharge occurs. The discharge cells 126 can be partitioned in a matrix, and are interposed between the front substrate 111 and the rear substrate 121.

The discharge cells 126 defined by the partition walls 130 can have other shapes including, but not limited to, stripes, or polygons including octagon or pentagon, or circles.

The rear panel 120 includes address electrodes 122 that extend in a direction orthogonal to, and are arranged to cross with, the X electrodes 113 and the Y electrodes 112. The address electrodes 122 may be fixed to the rear substrate 121. A discharge cell 126 is formed in a region where an address electrode 122 crosses with an X electrode 113 and a Y electrode 112.

Since the address electrodes 122 are disposed outside the light path of the visible rays generated in the fluorescent layer 125, the address electrodes 122 may be formed of a non-transparent material such as Cu, Ag, or Cr, which have good electric conductivity and are relatively inexpensive.

The rear panel 120 may include a second dielectric layer 123 covering the address electrodes 122. The second dielectric layer 123 protects the address electrode 122 from direct collision with accelerated charged particles, and accumulates charged particles as wall charges.

However, when the fluorescent layer 125, which will be described later, is formed on the rear substrate 121 inside the discharge cells 126 to cover the address electrodes 122, the fluorescent layer 125 can function as a dielectric layer. Therefore, the second dielectric layer 123 is not a necessary element in the PDP 100 according to an exemplary embodiment of the present invention.

The rear panel 120 includes the fluorescent layer 125 formed on the rear substrate 121 and disposed in the discharge cells 126, which are defined by the partition walls 130.

The fluorescent layers 125 may be disposed such that the discharge cells 126 of the PDP 100 are divided into red emission cells, green emission cells, and blue emission cells, to form a color image. When the second dielectric layer 123 is included, the florescent layer 125 can be formed by disposing a fluorescent paste on at least a portion of a front surface of the second dielectric layer 123 and the partition walls 130 in the discharge cells 126, and drying and sintering the doped result.

The fluorescent paste can be prepared by mixing a red emission fluorescent substance, a green emission fluorescent substance, or a blue emission fluorescent substance, together with a solvent and a binder. The red emission fluorescent substance may be (Y,Gd)BO3:Eu3+, or a similar material; the green emission fluorescent substance may be Zn2SiO4:Mn2+, or a similar material; and the blue emission fluorescent substance may be BaMgAl10O17:Eu2+, or a similar material.

The discharge cells 126 can be filled with a discharge gas at a pressure lower than atmospheric pressure, such as 0.5 atm or less. Thus, the vacuum between the front panel 110 and the rear panel 120 is supported by the partition walls 130. The discharge gas may include about 10% Xe and at least one of Ne, He, and Ar.

Hereinafter, the operation of the PDP 100 according to an exemplary embodiment of the present invention and the (1,1,1) growth direction 119 of crystals 116*b* in the protecting layer 116 will be described with reference to FIG. 3.

The PDP 100 according to an exemplary embodiment of the present invention may operate using an Address-Display Separation (ADS) operation method, an Alternate Lighting of Surfaces (ALIS) operation method, or similar operation method. The operation method used determines many properties of a PDP, such as quality or response speed of the PDP 100. However, since such operation methods do not alter the operation of the present invention, operation of a PDP according to an exemplary embodiment of the present invention will be described with respect to the ADS operation method.

In general, to form an image, discharge occurs in discharge cells 126 of a PDP 100. As a result of the discharge, the discharge cells 126 have different states of wall charges and accumulate different amounts of charged particles. To prevent difficulty in controlling the discharge due to the different states in the discharge cells 126, a voltage greater than a discharge voltage is supplied to all of the discharge cells 126 to simultaneously generate a discharge in the discharge cells 126. As a result, discharge cell 126 wall charges are removed. Additionally, all discharge cells 126 become uniformly charged, and charged particles in the discharge cells achieve a uniform state. This process is known as a reset discharge. The reset discharge is generally performed by supplying a high potential to one of the pair of electrodes 114 and by supplying a ground potential to the address electrodes 122 to generate a reset discharge all of the discharge cells 126.

After the reset discharge occurs, an address discharge occurs in a discharge cell 126 selected to emit light. A discharge cell 126 is selected by supplying a pulse voltage to one electrode of the pair of electrodes 114 and a pulse voltage to a selected address electrode 122, which cross with each other at the selected discharge cell 126. The pulse voltage is applied to the selected address electrode 122 and the selected electrode 114 by an external power source to select a discharge cell 126. When the potential difference between the selected electrode 114 and the address electrode 122 exceeds a discharge voltage, an address discharge is generated in the selected discharge cell 126. Due to the address discharge, charged particles are accumulated on an inner surface of the discharge cell 126 as wall charges to stimulate a sustain discharge.

Although the address discharge can occur by specifying a Y electrode 112 and an address electrode 122 or by specifying an X electrode 113 and an address electrode 122, address discharge generally occurs between a Y electrode 112 and an address electrode 122.

After the address discharge occurs, the sustain discharge occurs, thus emitting light from the discharge cell 126 to form an image on the PDP 100. The sustain discharge is generated in a discharge cell 126 by alternately and repeatedly applying a potential difference across the pair of electrodes 114 to emit visible light of a predetermined color from the discharge cell 126 selected by the address discharge, and to form an image on the PDP 100. Because every pair of electrodes 114 disposed on the front panel 110 are alternately and repeatedly applied with a potential difference lower than the sustain discharge firing voltage, only the discharge cells 126 selected by address discharge perform a sustain discharge. This is because the wall charges only accumulate in the discharge cells 126 that experience address discharge. To then generate sustain discharge, the potential of the wall charge plus the potential difference formed across the pair of electrodes 114 exceeds the sustain discharge firing voltage. Accordingly, sustain discharge occurs only in discharge cells 126 where address discharge has first occurred. Sustain discharge in a discharge cell 126 thus generates ultra violet rays, which excite the fluorescent layer 125 in the discharge cell 126 to emit visible light rays. As a result, an image can be displayed on the PDP 100.

For example, positive wall charges can accumulate to the Y electrode 112 and negative wall charges can accumulate to the X electrode 113 in a discharge cell 126 as a result of address discharge. A positive voltage pulse can then be applied to the Y electrode 112 while a ground voltage pulse is applied to the X electrode 113. Therefore, an electric field is formed in the first dielectric layer 115 that covers the X electrode 113 and the Y electrode 112. The electric field accelerates wall charges.

When the described voltage pulses are applied to the X electrode 1113 and the Y electrode 112, an equipotential plane ($E_l$) is formed in the first dielectric layer 115 along surface of the X electrode 113 and the Y electrode 112. In the present exemplary embodiment shown in FIG. 3, since the first dielectric layer 115 has the groove 117 formed between the X electrode 113 and the Y electrode 112, an electric field, which is formed substantially perpendicular to $E_l$, is focused in the groove 117.

In addition, although the pair of electrodes 114 do not substantially face each other, a sustain discharge similar to a sustain discharge where the pair of electrodes 114 substantially face each other ("facing discharge") can be obtained. The electric field, which is formed in the first dielectric layer 115 and the groove 117 by a potential difference across the pair of electrodes 114 as described above, allows charged particles to be easily accelerated.

Accordingly, when a potential difference is applied between the X electrode 113 and the Y electrode 112, wall charges accelerate and collide into the groove 117 formed in the first dielectric layer 115 and the protecting layer 116. Therefore, the portion of the protecting layer 116 corresponding to the groove 117 can be damaged by frequent collisions with charged particles.

In particular, since sustain discharge similar to facing discharge is generated, accelerated charged particles will very likely collide with a portion of the protecting layer 116 corresponding to the inclined surfaces 115*a* of the groove 117. Thus, the portion of the protecting layer 116 corresponding to the inclined surfaces 115*a* of the groove 117 can be damaged by frequent collisions with charged particles. To prevent damage and a decrease in expected life of the PDP 100, the protecting layer 116 corresponding to the inclined surfaces 115*a* can have a sputtering resistance sufficient to withstand the frequent collision with charged particles.

The sputtering resistance is closely related to the density of crystals 116*b* of a protecting layer 116. For example, as the density of the crystals increases, the sputtering resistance of the protecting layer also increases. When the (1,1,1) growth direction 119 of the protecting layer 116 is substantially perpendicular to an inclined surface 115*a*, the density of the protecting layer 116 may significantly increase, and the sputtering resistance of the protecting layer 116 may also increase.

Additionally, as described above, the portion of the protecting layer 116 corresponding to the inclined surfaces 115*a* of the groove 117 may collide with the accelerated charged particles. Therefore, when the portion of the protecting layer 116 corresponding to the inclined surfaces 115*a* of the groove 117 is disposed to emit secondary electrons by colliding with charged particles, more charged particles can be discharged. As a result, the discharge intensity increases and discharge characteristics of The PDP 100 may improve.

Where the (1,1,1) growth direction 119 of crystals 116*b* of the protecting layer 116 corresponding to the inclined surface 115*a* is substantially perpendicular to the inclined surfaces 115*a*, the electric field is focused strongly on the crystals 116*b* of the protecting layer 116. Additionally, when charged particles collide with the protecting layer 116, more secondary electrons are emitted. Accordingly, the PDP 100 can have better discharge characteristics when the (1,1,1) growth direction 119 of the crystals of the protecting layer 116 disposed on the inclined surface 115*a* is substantially perpendicular to the inclined surfaces 115*a*.

The (1,1,1) growth direction 119 of the crystals of the protecting layer 116 can be disposed substantially perpendicular to the inclined surfaces 115*a* by controlling parameters of a deposition process using an e-beam evaporator, a sputter, or similar process. The parameters may include deposition temperature, which is a thermal energy condition, and deposition speed, which is a kinetic energy condition, an oxygen partial pressure, and other similar parameters.

In addition, the crystals 116*b* of the protecting layer 116 disposed on the inclined surfaces 115*a* may be small. By controlling a surface state in the deposition process, the growth direction of the crystals of the protecting layer 116 can be disposed substantially perpendicular to the inclined surface 115*a*.

As described above, the (1,1,1) growth direction of the crystals 116*b* of the protecting layer 116 disposed on the inclined surfaces 1115*a* may be disposed substantially perpendicular to the inclined surfaces 115*a*. Furthermore, when a recessed surface 115*b* connecting the inclined surfaces 115*a* is formed in the groove 117, the (1,1,1) growth direction 119 of crystals 116*b* of the protecting layer 116 corresponding to the recessed surface 115*b* may be disposed substantially perpendicular to the recessed surface 115*b*.

In addition, the (1,1,1) growth direction 119 of crystals 116*b* of the protecting layer 116 corresponding to a region of the first dielectric layer 115 outside the groove 117, defined as planar surface 115*c*, may be substantially perpendicular to the planar surface 115*c* of the first dielectric layer 115.

Since sustain discharge similar to facing discharge is generated in the groove 117 as described above, the portion of the protecting layer 116 corresponding to the inclined surface 115*a* of the groove 117 may repeatedly collide with the accelerated charged particles, and as a result, be damaged quickly. Therefore, even if the portion of the protecting layer 116 corresponding to the recessed surface 115*b* of the groove 117 or the portion of the protecting layer 116 corresponding to the planar surface 115*c* remains, deterioration of the portion of the protecting layer 116 corresponding to the inclined surface 115*a* through prolonged use of the PDP 100 may result in damage to the first dielectric layer 115 and the pair of electrodes 114, thereby causing the PDP 100 to malfunction. Therefore, the expected life of a PDP can be determined by damage to the portion of the protecting layer 116 corresponding to the inclined surfaces 115*a*.

Accordingly, when the portion of the protecting layer 116 corresponding to the inclined surfaces 115*a* is thicker than the the portions of the protecting layer 116 corresponding to the planar portion 115*c* and recessed surface 115*b* of the first dielectric layer 115, the expected life of the PDP 100 according to an exemplary embodiment of the present invention may increase.

Figure 4:
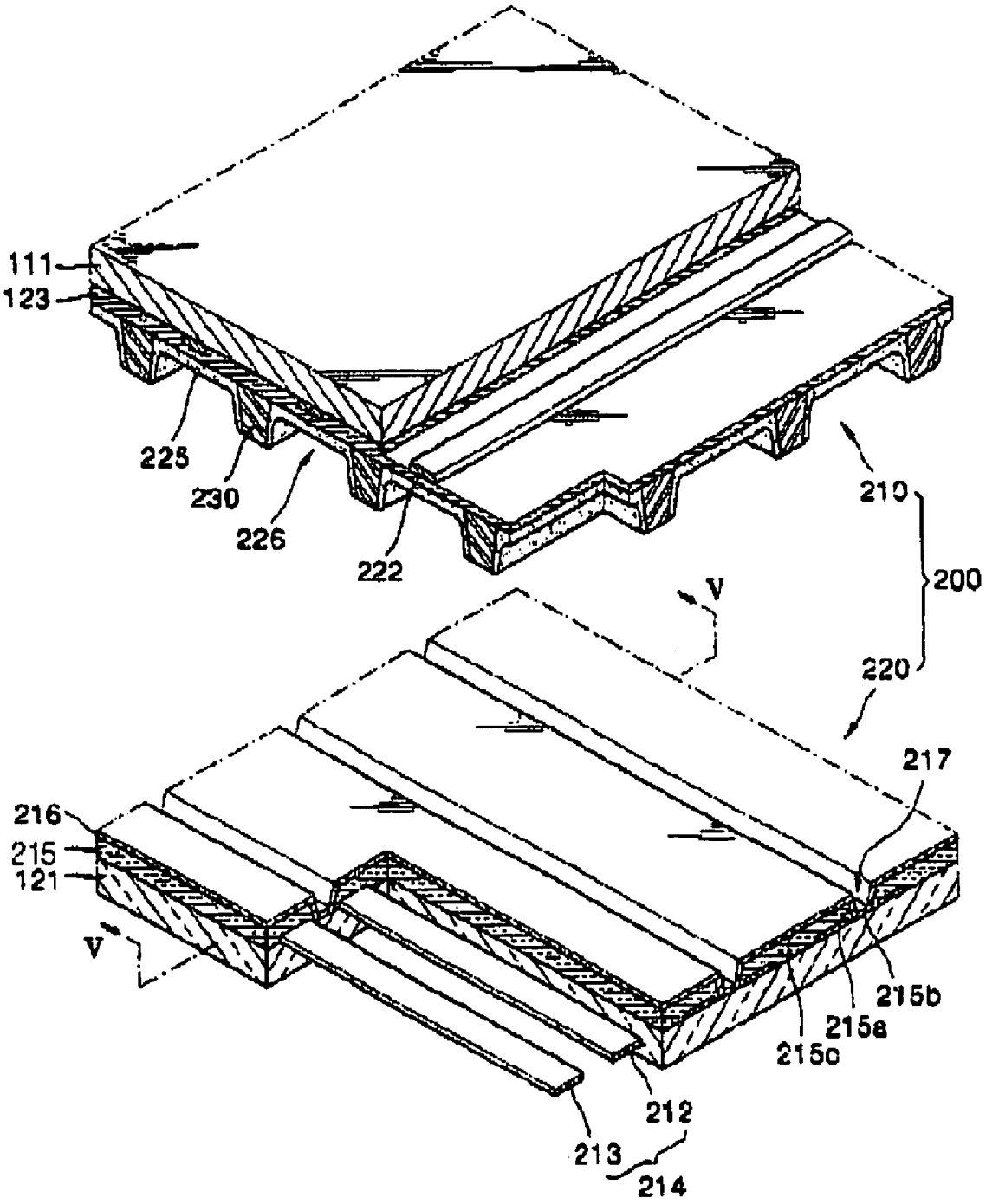
FIG. 4 shows a PDP according to a second exemplary embodiment of the present invention.
Figure 5:
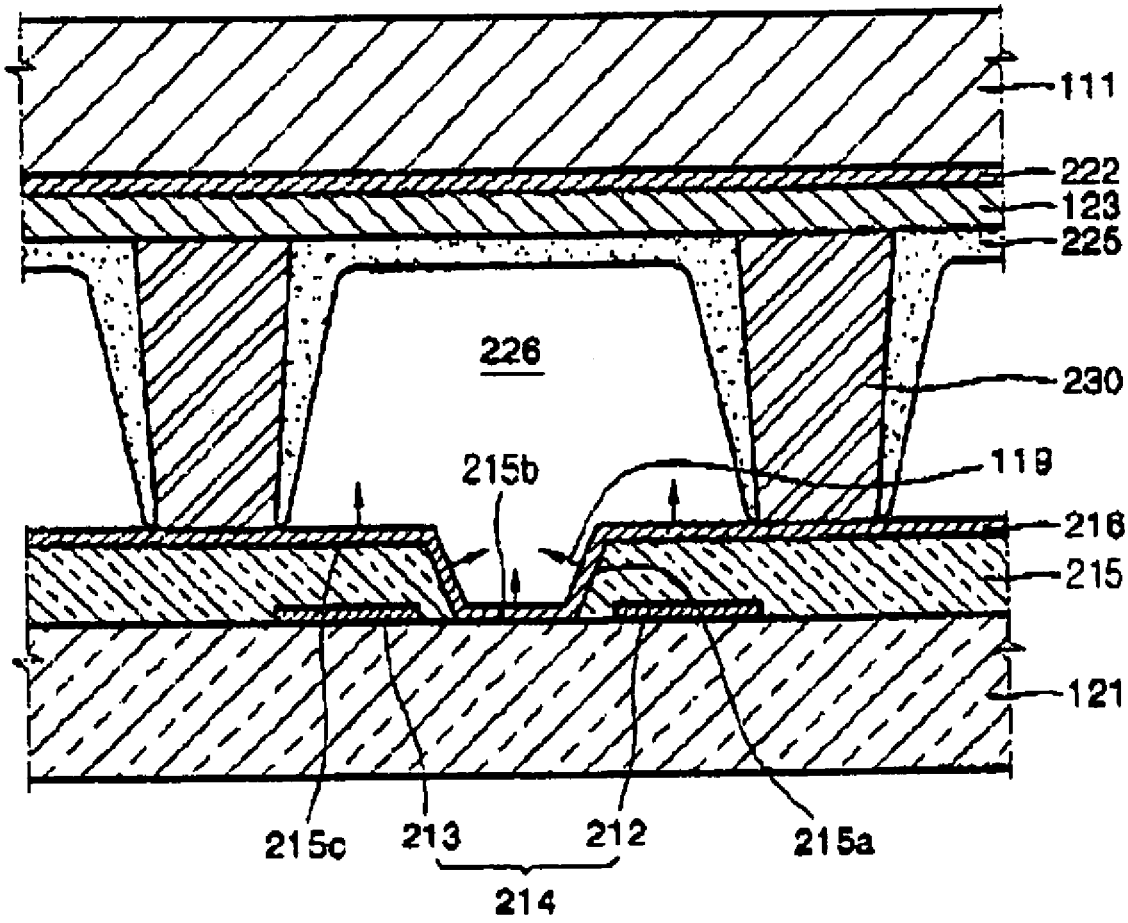
FIG. 5 shows a section view taken along line V-V of FIG. 4.

Hereinafter, a PDP 200 according to a second exemplary embodiment of the present invention will be described with reference to FIG. 4 and FIG. 5 and compared with the PDP 100 according to the previous exemplary embodiment.

The PDP 200 according to the second exemplary embodiment of the present invention is different from the PDP 100 according to the previous exemplary embodiment in that a rear panel 220 includes a plurality of pairs of electrodes 214. Each pair of electrodes 214 includes an X electrode 213 and a Y electrode 212 fixed to a rear substrate 121, and a front panel 210 includes a plurality of address electrodes 222 fixed to a front substrate 111.

In this second exemplary embodiment, the address electrodes 222 are disposed in the light path of visible rays emitted from a fluorescent layer 225. Therefore, the address electrode 222 may be formed of transparent material such as ITO or similar material.

Additionally, the pairs of electrodes 214 may be formed of a non-transparent material because they are disposed outside of the light path of the visible rays emitted from a fluorescent layer 225. Therefore, the electrodes 214 can be formed of a metal with good electrical conductivity, such as Ag, Cu, Cr, or similar materials.

In this second exemplary embodiment, the rear panel 220 includes a first dielectric layer 215 that covers the electrodes 214 and has a plurality of grooves 217, where a groove 217 is interposed between an X electrode 213 and a Y electrode 212 of a pair of electrodes 214. A groove 217 may include an inclined surface 215*a*, a recessed surface 215*b* coupled with inclined surfaces 215*a*, and a planar surface 215*c*, similar to the first exemplary embodiment.

In the second exemplary embodiment of the present invention, a sustain discharge is generated in a discharge cell 226 due to the pair of electrodes 214 which are fixed to the rear substrate 121. A portion of the protecting layer 216 corresponding to the inclined surfaces 215*a* of the grooves 217 is likely to collide with accelerated charged particles. Accordingly, the (1,1,1) growth direction 119 of crystals of the protecting layer 216 corresponding to the inclined surface 215*a* of the groove 217 may be substantially perpendicular to the inclined surface 215*a*.

In addition, when the grooves 217 further have recessed surfaces 215*b*, the (1,1,1) growth direction 119 of crystals of the protecting layer 216 corresponding to the recessed surfaces 215*b* may be substantially perpendicular to the recessed surfaces 215*b*.

The (1,1,1) growth direction 119 of crystals of the protecting layer 216 corresponding to a region of the first dielectric layer 215 outside the groove 217, defined as planar surface 215*c*, may be substantially perpendicular to the planar surface 215*c* of the first dielectric layer 215.

As described in the second exemplary embodiment of the present invention, the scope of the present invention is not limited by the arrangement of electrodes. The present invention may encompass any structure in which a dielectric layer covering electrodes has grooves and is covered by a protecting layer.

For example, the present invention encompasses a structure in which a Y electrode extends in a direction orthogonal to the direction of the X electrode, and the Y electrode and X electrode are formed in the partition walls around a discharge cell. In such an embodiment, the dielectric layer is formed on the partition wall of the discharge cell, and has a groove formed between the X electrode and the Y electrode. The protecting layer covers the dielectric layer, and the (1,1,1) growth direction of crystals of the protecting layer corresponding to the inclined surfaces of the groove may be substantially perpendicular to the inclined surfaces of the groove.

The present invention achieves technical advantages which will be described below.

First, the growth direction of a portion of the protecting layer with which charged particles frequently collide is optimized to increase sputtering resistance, and thus, the expected life of a PDP can be increased.

Secondly, the growth direction of a portion of the protecting layer with which charged particles frequently collide is optimized to increase the amount of emitted secondary electrons, thus increasing the amount of discharge of a PDP and improving discharge characteristics of the PDP.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a transparent front substrate and a rear substrate facing each other;

partition walls that define discharge cells and which are interposed between the transparent front substrate and the rear substrate;

a first electrode and a second electrode interposed between the transparent front substrate and the rear substrate and corresponding to the discharge cells;

a dielectric layer covering the first electrode and the second electrode and having a groove with a first inclined surface interposed between a first electrode and a second electrode;

a protecting layer covering the dielectric layer;

a fluorescent layer disposed in a discharge cell; and a discharge gas disposed in the discharge cell, wherein a (1,1,1) growth direction of crystals of the protecting layer corresponding to the first inclined surface of the groove is substantially perpendicular to the first inclined surface of the groove, wherein the dielectric layer has a second inclined surface of the groove interposed between the first electrode and the second electrode and a recessed surface coupled between the first inclined surface and the second inclined surface, and wherein a portion of the protecting layer corresponding to the first inclined surface or the second inclined surface is thicker than a portion of the protecting layer corresponding to the recessed surface.

2. The plasma display panel of claim 1, further comprising:

an address electrode extending in a first direction, wherein the first electrode is an X electrode, the second electrode is a Y electrode, and the X electrode and the Y electrode extend substantially parallel to each other in a second direction orthogonal to the first direction.

3. The plasma display panel of claim 2, wherein the groove is formed between the X electrode and the Y electrode.

4. The plasma display panel of claim 1, wherein the (1,1,1) growth direction of crystals of the protecting layer covering a non-groove portion of the dielectric layer is substantially perpendicular to a surface of the non-groove portion of the dielectric layer.

5. A plasma display panel, comprising:

a transparent front substrate and a rear substrate facing each other;

partition walls that define discharge cells and which are interposed between the transparent front substrate and the rear substrate;

an X electrode and a Y electrode fixed to the transparent front substrate;

a first dielectric layer covering the X electrode and the Y electrode, and having a groove with a first inclined surface interposed between the X electrode and the Y electrode;

a protecting layer covering the first dielectric layer;

a fluorescent layer disposed in a discharge cell; and a discharge gas disposed in the discharge cell, wherein a (1,1,1) growth direction of crystals of the protecting layer corresponding to the first inclined surface of the groove is substantially perpendicular to the first inclined surface of the groove, wherein the dielectric layer has a second inclined surface of the groove interposed between the first electrode and the second electrode and a recessed surface coupled between the first inclined surface and the second inclined surface, and wherein a portion of the protecting layer corresponding to the first inclined surface or the second inclined surface is thicker than a portion of the protecting layer corresponding to the recessed surface.

6. The plasma display panel of claim 5, further comprising:

an address electrode fixed to the rear substrate, and extending in a first direction, wherein the X electrode and the Y electrode extend parallel to each other in a second direction substantially orthogonal to the first direction.

7. The plasma display panel of claim 6, further comprising: a second dielectric layer covering the address electrodes.

8. The plasma display panel of claim 5, wherein the (1,1,1) growth direction of crystals of the protecting layer covering a non-groove portion of the first dielectric layer is substantially perpendicular to a surface of the non-groove portion of the first dielectric layer.

9. A plasma display panel, comprising:

a transparent front substrate and a rear substrate facing each other;

partition walls that define discharge cells and which are interposed between the transparent front substrate and the rear substrate;

an X electrode and a Y electrode fixed to the rear substrate;

a first dielectric layer covering the X electrode and the Y electrode, and having a groove with a first inclined surface interposed between the X electrode and the Y electrode;

a protecting layer covering the first dielectric layer;

a fluorescent layer disposed in a discharge cell; and a discharge gas disposed in the discharge cell, wherein a (1,1,1) growth direction of crystals of the protecting layer corresponding to the first inclined surface of the groove is substantially perpendicular to the first inclined surface of the groove, wherein the dielectric layer has a second inclined surface of the groove interposed between the first electrode and the second electrode and a recessed surface coupled between the first inclined surface and the second inclined surface, and wherein a portion of the protecting layer corresponding to the first inclined surface or the second inclined surface is thicker than a portion of the protecting layer corresponding to the recessed surface.

10. The plasma display panel of claim 9, further comprising:

an address electrode fixed to the front substrate, and extending in a first direction, wherein the X electrode and the Y electrode extend parallel to each other in a second direction substantially orthogonal to the first direction.

11. The plasma display panel of claim 10, wherein the address electrodes are transparent electrodes.

12. The plasma display panel of claim 10, further comprising: a second dielectric layer covering the address electrode.

13. The plasma display panel of claim 9, wherein the (1,1,1) growth direction of crystals of the protecting layer disposed on the recessed surface is substantially perpendicular to the recessed surface.

14. The plasma display panel of claim 9, wherein the (1,1,1) growth direction of crystals of the protecting layer covering a non-groove portion of the first dielectric layer is substantially perpendicular to a surface of the non-groove portion of the first dielectric layer.

* * * * *